United States Patent [19]

Suhr et al.

[11] 4,049,148

[45] Sept. 20, 1977

[54] CHILD RESISTANT CLOSURE ASSEMBLY

[75] Inventors: Donald C. Suhr, Farmington Hills, Mich.; Peter Hedgewick, Windsor, Canada

[73] Assignee: International Tools (1973) Ltd., Windsor, Canada

[21] Appl. No.: 739,172

[22] Filed: Nov. 5, 1976

Related U.S. Application Data

[63] Continuation-in-part of Ser. No. 687,740, May 19, 1976, abandoned.

[51] Int. Cl.[2] ..... B65D 53/00; B65D 55/02

[52] U.S. Cl. ..... 215/214; 215/222; 215/354

[58] Field of Search ..... 215/211, 212, 214, 222, 215/342, 343, 346, 350, 351, 354

[56] References Cited

U.S. PATENT DOCUMENTS 3,072,276 1/1963 Nichols ..... 215/222

3,974,928 8/1976 Domaracki et al. ..... 215/211

*Primary Examiner*—Geroge T. Hall

*Attorney, Agent, or Firm*—Reising, Ethington, Barnard, Perry & Brooks

[57] ABSTRACT

A child resistant safety closure and container assembly of the type including a cap having locking lugs projecting from its skirt for engagement with complementary bayonet locking elements on the container. A combined spring and sealing member is carried by the cap to resiliently maintain the cap and container in locked engagement, and provide a moisture proof seal. The spring and sealing member includes a plunger having a cylindrical base portion concentric with a cylindrical sealing wall. A plurality of radial stiffening members extend between the base portion and the inner end of the cylindrical sealing wall. In one embodiment, the stiffening members are in the form of ribs molded integrally to the side wall. In another embodiment, the stiffening members are in the form of flutes molded into the side wall.

21 Claims, 7 Drawing Figures

CHILD RESISTANT CLOSURE ASSEMBLY

This application is a continuation-in-part of application Ser. No. 687,740, filed May 19, 1976, now abandoned, the entire disclosure of which is incorporated herein by reference.

BACKGROUND OF THE INVENTION

1. Field of the Invention

This invention relates generally to safety closure and container assemblies, and is particularly concerned with an improvement in safety closure and container assemblies wherein it is necessary to provide a liquid or moisture-proof seal for the contents of the container.

2. Description of the Prior Art

In order to reduce the number of accidental poisonings resulting from young children having access to unsafe medicines, drugs, household chemicals and other products, there has been considerable activity in recent years towards the development of closures and containers in which a type of manipulation between the cap and container is required in order to gain access to the contents of a container that a young child is incapable of performing. For example, it has been found that young children are generally incapable of manipulating a cap mounted on a container with bayonet-type locking means, that is, a type of locking means that requires that the cap be pushed axially relative to the container and then rotated relative to the container in order to separate the cap from the container. The cap must be pushed axially toward the container against the biasing force of a spring in order to disengage the bayonet locking means. See, for example, Hedgewick U.S. Pat. No. Re. 27,156.

When the contents of the container is liquid, or is some substance that deteriorates in an atmosphere of high humidity, the closure must be capable of maintaining an adequate seal under a variety of conditions. The contents of the container, if liquid, may require vigorous shaking before being used, or the contents may be of the type that causes a pressure buildup within the container over a period of time. A tight seal is also necessary in order to prevent the undesired escape of the contents from the container, and because the entrance of moisture into the container may cause deterioration of the contents.

In order to maintain a good seal against the entrance or escape of moisture, it is desirable to be able to provide a seal that projects into the mouth of the container and engages the inner surface of the container mouth with a tight fit. While the spring force on the cap should be sufficient to prevent children from gaining access to the contents, it should not be so great as to make it unduly difficult for adults to manipulate the cap. Accordingly, a tight seal must be maintained by the closure without at the same time making it too difficult for adults to manipulate the closure. Since the closure must be applied to and removed from the container many times, the spring member must be capable of many cycles of deflection and relaxation without rupture. Furthermore, the construction of the closure and spring member must be such that the seal is firmly pressed against the container rim and the inner surface of the mouth of the container when the closure is placed on the cap and locked in position.

Hedgewick et al U.S. Pat. Nos. 3,478,911 and 3,485,403 illustrate safety cap and container assemblies wherein a flat disk overlies the container rim and is held captive in the cap by the bayonet lugs of the cap. In the construction illustrated in the latter Hedgewick et al patents, the flat disk is pressed against the container rim by elements formed integrally with and projecting from the end wall of the caps of the closure assemblies.

In Nichols U.S. Pat. No. 3,072,276, a closure assembly is illustrated in which a cap having bayonet lugs includes a plastic disk member which is dished at its center with the thickened periphery of the disk member overlying the bayonet locking lugs of the cap. An axially depending flange is received in the mouth of the container. A post projects integrally upwardly from the disk to engage the end wall of the cap and to cause the disk to deflect when the cap is applied to the container, the post projecting from the central axis of the disk.

Bugla U.S. Pat. No. 3,432,065 and Hedgewick and Bauer U.S. Pat. No. 3,753,510 disclose closure assemblies wherein biasing and sealing members are secured to the end wall of a safety cap by interconnecting members formed on the spring member and the end wall of the respective safety caps.

Bauer U.S. Pat. No. 3,623,623 illustrates a safety package wherein a spring and sealing member is secured to the container, the spring member having an axial opening through which the contents of the container can be dispensed.

SUMMARY OF THE INVENTION

An object of this invention is to provide a safety closure and container assembly wherein a moisture-proof seal is maintained by the pressure of a spring member constructed so as to apply an axial force efficiently at the sealing member in such a manner as to press the sealing member tightly into engagement with the container.

A further object is to provide a safety or child resistant closure and container assembly wherein a tight, moisture-proof seal is maintained when the closure is applied to a container by a unitary spring and sealing member held captive in the cap portion of the closure assembly by the cap bayonet lugs, so that the cap lugs pull the sealing portion out of engagement with the container when the cap is removed from the container so that the force required to remove the sealing portion from the container is spread among the cap bayonet lugs.

In carrying out the foregoing, and other objects, a child resistant closure assembly according to the present invention includes a cap having an end wall with a skirt projecting therefrom with bayonet locking means formed on and projecting from the inner wall of the skirt for selective engagement with and disengagement from complementary bayonet locking means formed on the container by a combined axial and rotative motion of the cap relative to such container. A combined spring and sealing member is carried by the cap for biasing the cap bayonet locking means toward locked engagement with the container bayonet locking means, while at the same time maintaining a tight seal at the rim and mouth of the container to prevent the undesired escape of liquid contents from the container, or, alternatively, to minimize the entrance of moisture into the container.

The combined spring and sealing member is in the form of a one piece molded plastic body having a cylindrical sealing wall for engaging the inner wall of the mouth of the container. A flange projects radially outwardly from one end of the cylindrical sealing wall for overlying the container rim. The integral body includes a plunger having a cylindrical base portion concentric with the cylindrical sealing wall. The base portion has an outer end for engaging the end wall of the cap. A side wall extends between the periphery of the inner end of the base portion and the periphery of the end of the cylindrical sealing wall opposite the flange. The side wall flares outwardly from the base portion to the cylindrical sealing wall. A plurality of radial stiffening members extend between the base portion and the inner end of the cylindrical sealing wall. In one form of the invention, the stiffening members comprise a plurality of ribs extending between the base portion and the sealing wall. The ribs each have an inner edge molded integrally to the outer surface of the side wall and project outwardly to the free edge. When the cap is pressed toward the container, the base portion moves toward the inner end of the cylindrical sealing wall, and the resulting flexure of the flared bell shaped side wall, and the movement of the ribs, applies radial outward sealing force on the sealing wall to provide a tight engagement between the sealing wall and the wall of the container.

In another embodiment, the radial stiffening members are in the form of flutes molded into the side wall. The flutes tend to spread and increase the circumference of the inner end of the cylindrical sealing wall in response to movement of the base portion toward the inner end of the cylindrical sealing wall.

Other objects, advantages and features of the invention will become apparent from the following description taken in connection with the accompanying drawings.

DESCRIPTION OF THE PREFERRED EMBODIMENTS

Figure 1:
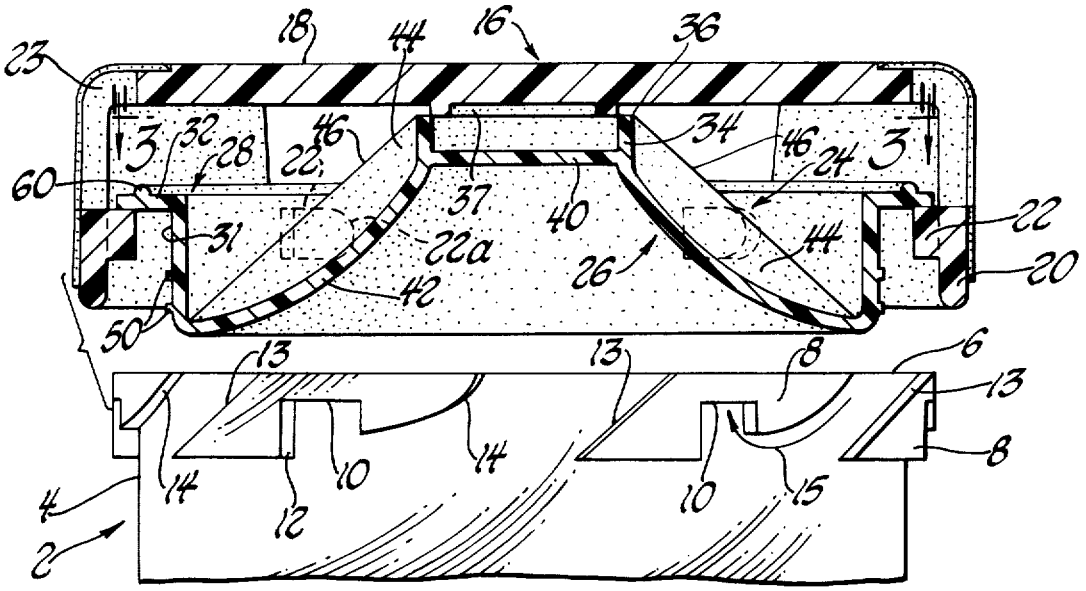
FIG. 1 is a sectional view of one form of safety closure assembly embodying the invention, the closure assembly being removed from the container.
Figure 2:
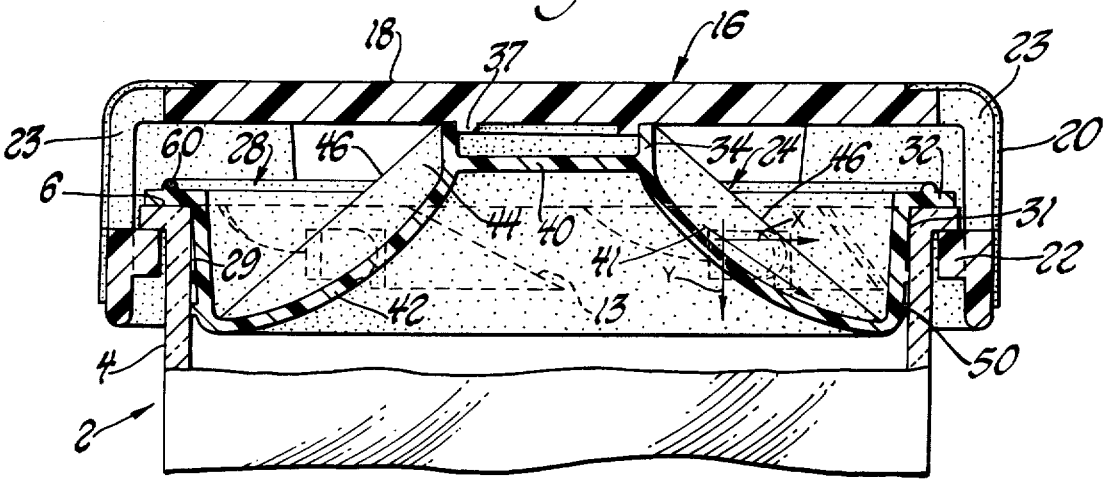
FIG. 2 is a sectional view of a safety closure and container assembly wherein the closure assembly of FIG. 1 is applied.
Figure 3:
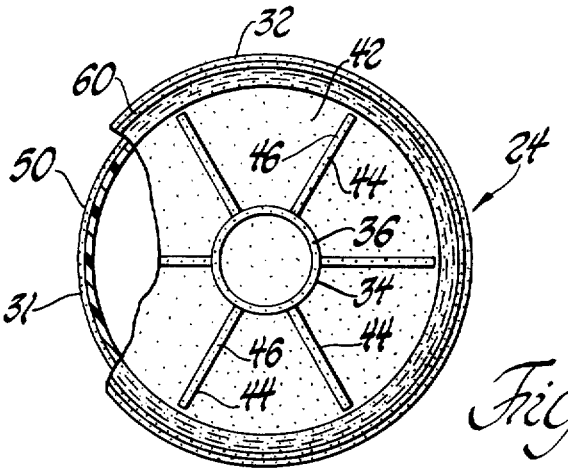
FIG. 3 is a plan view of the combined spring and sealing member of the closure assembly of FIGS. 1 and 2 as viewed along lines 3—3 of FIG. 1.

With reference to the drawings, a safety closure and container assembly according to the embodiment of FIGS. 1 through 3 includes a container designated generally by reference numeral 2 (FIG. 2) and having a neck or mouth portion 4 with an annular rim 6. Formed on the outer surface of the mouth portion 4 is a plurality (six in the illustrated embodiment) of container locking elements 8, of the bayonet type, which are spaced peripherally from each other on the outer surface of the mouth portion. The container locking elements 8 may be spaced socket members projecting from the mouth portion 4 of the configuration disclosed in Hedgewick U.S. Pat. No. Re. 27,156 including a socket or notch 10 formed between a cam surface 14 and a depending stop portion 12. The cam surface 14 extends from the leading end of each container locking element 8 at the top surface thereof to the socket 10. Additionally, the stop portion 12 is formed with a ramp portion 13. The ramp portion 13 extends from the top surface of the locking element 8 downwardly to a trailing end of the locking element 8 at the end of the opposite side of the socket 10 from the leading end.

The safety closure assembly for container 2 in the illustrated embodiment of FIGS. 1 through 3 includes a cap 16 having an end wall 18 with a peripheral skirt 20 projecting axially therefrom for receiving the mouth portion 4 of the container 2. A plurality of cap locking elements 22, in the form of bayonet lugs, are spaced peripherally from each other and project inwardly from the inner surface of skirt 20. The cap locking elements 22 are in the form of radially inwardly projecting lugs integrally molded with the skirt 20, and are bayonet locking means in the sense that they cooperate, in bayonet fashion, with the container locking elements 8. The upper surfaces of the lugs 22 may be formed by apparatus of the type disclosed in U.S. Pat. No. 3,904,165. Consequently, openings 23 are formed in the skirt and end wall portions of the cap at each lug 22. Alternatively, the openings 23 may be omitted as in U.S. Pat. Nos. 3,623,623 and 3,756,445, for example.

The cap locking elements 22 are complementary to the container locking elements 8 such that the locking elements or lugs 22 are engageable with the notches 10 in the container locking elements 8. The cap locking elements 22 are engageable with and disengageable from the container locking elements 8 by an axial motion followed successively by a rotative motion of the cap relative to the container. In order to apply the cap 16 to the container 2, the cap locking elements 22 are aligned with the spaces between the adjacent container locking elements 8 with the mouth portion 4 received in the skirt 20. Axial pressure of the cap toward the container coupled with rotation of the cap relative to the container 2 causes the cap locking elements 22 to engage the respective cam surfaces 14 until the locking elements 22 come into axial alignment with the respective notches. The path of each lug 22 when the cap is applied to the container is illustrated by arrow 15 in FIG. 1. The lug 22 moves from the leading end of the container locking element 8 down the cam surface 14, into the socket 10. In the illustrated embodiment, each lug 22 is of semicircular configuration at one end as indicated by reference numeral **22*a* to assist in providing a sliding engagement between the lugs 22 and the cam surface 14 of the container locking elements 8** as well as to reduce wear due to the elimination of sharp corners.

With the upper surfaces of the cap locking elements 22 engaged with the upper surfaces of the respective notches 10, the end wall 18 of cap 16 has a fixed axial position relative to rim 6 since the cap locking elements are located at an equal axial distance from the wall 18 of skirt 20, and the container locking elements 8 are located an equal axial distance from rim 6. Cap 16 is biased against axial movement from locked engagement with the container, and a liquid and moisture seal is maintained for the contents of the container, by a one-piece plastic spring and sealing member designated collectively by reference number 24.

The spring and sealing member 24 comprises a one-piece molded plastic body having an annular sealing portion designated generally by reference numeral 28 which, when the closure assembly is applied to the container as illustrated in FIG. 2, engages the rim 6 and the inner surface 29 of the mouth portion of the container. A plunger 26 is formed integrally with the sealing portion 28.

The sealing portion 28 includes a cylindrical sealing wall 31 for engaging the inner surface of the mouth of the container, and a flange 32 projecting radially outwardly from the upper or outer end of the sealing wall 31 for overlying the container rim 6.

The plunger portion 26 has a cylindrical base portion 34 which is concentric with the sealing wall 31. The base portion 34 has an outer cap engaging end 36 for engaging the inner surface of the end wall of the cap. A cylindrical projection 37 is formed integrally on the inner surface of the end wall 18 of the cap for cooperating with the base portion 34 to maintain the spring member 24 centered with respect to the cap. When the cap is in the locked position with respect to the container as illustrated in FIG. 2, the interengagement between the projection 37 and base portion 34 prevents transverse movement of the cap relative to the container so that the cap can only be disengaged from the container by movement in a substantially axial direction.

The base portion 34 is formed with a closure portion 40 at the inner end of the cylindrical wall of the base portion. Extending between the lower end of the base portion 34 and the inner end of the sealing wall 31 opposite flange 32 is a side wall 42. The side wall 42 is of annular cross-section, and flares outwardly in bell shaped configuration from the periphery of the lower end of the base portion 34 to the periphery of the lower, inner end of the sealing container 31.

Extending between the base portion 34 and the inner end of the cylindrical sealing wall is a plurality (six in the illustrated embodiment) of radial stiffening members in the form of ribs 44. The ribs 44 each has an inner edge molded integrally to the base portion 34 and the outer surface of the side wall 42. The ribs 44 each project outwardly from the side wall 42 to a free edge 46. When the cap is pressed axially toward the container, the base portion moves toward the lower edge of the cylindrical sealing wall 31, and the resulting flexure of the side wall 42 applies downward and radially outward forces on the sealing wall 31 and flange 32. The direction of the force is illustrated by arrow 41 in FIG. 2. The radially outward force causes tight, sealing engagement between the sealing wall 31 and the inner wall of the mouth portion of the container.

In the illustrated embodiment of FIGS. 1 and 2, the radially extending annular sealing flange 32 overlies the cap locking elements 22. When the cap is removed from the container, the container locking elements 22 serve to hold the spring and sealing member 24 captive between the end wall 18 of the cap and the cap locking elements 22. The spring and sealing member 24 is otherwise unconnected with the cap 16.

The assembly of the cap 16 and sealing member 24 are shown disengaged from the container in FIG. 1. In the position of the member 24 as illustrated in FIG. 1, with the sealing flange 32 resting on the upper surfaces of the lugs 22, the base portion 34 only lightly engages or possibly may be spaced slightly from the end wall 18 of the cap 16. However, as illustrated in FIG. 2, when the cap locking elements 22 are engaged with the container locking elements 8, the cap engaging portion 36 engages the end wall 18 of the cap causing the flared or bell shaped side wall portion 42 to flex downwardly and outwardly to resiliently apply both an axial and radially outward component of force to press the sealing portion 28 into tight sealing engagement with the inner surface 29 of the container and against the rim 6.

In the illustrated embodiment of FIGS. 1 through 3, a pair of axially spaced sealing beads 50 project outwardly from the sealing wall 31. In the closed position of the cap as shown in FIG. 2, the beads 50 are pressed into tight engagement with the inner surface 29 of the mouth portion of the container.

The axial component of force, indicated by arrow Y in FIG. 2 forces the axially extending sealing wall 31 into the mouth of the container and forces the radially extending sealing flange 32 into tight sealing engagement with the rim 6. The radially outwardly component of force, indicated by arrow X in FIG. 2, forces the cylindrical sealing wall 31 into tight sealing engagement with the inner surface of the mouth of the container. Sealing pressure is applied particularly at the periphery of the lower or inner end of the cylindrical sealing wall 31 beneath beads 50.

When the closure assembly is removed from the cap, the spring member 26 is depressed to permit the lugs 22 to disengage from the notches of the container locking elements 8 whereupon the cap can be rotated to permit the lugs 22 to pass between the adjacent pairs of container locking elements 8. As the cap continues to rotate, the cap locking elements 22 are cammed up the ramps 13 from the trailing end of the adjacent locking element 8 to engage the flange 32 and force the sealing flanges 32 and 31 to separate from the container.

An annular stop rim 60 may be formed on the upper surface of flange 32 to engage the end wall of the cap to prevent overstressing of element 24 when the cap is pressed toward the container. Alternatively, a stop ring can be formed on the inner surface of the cap end wall.

Figure 4:
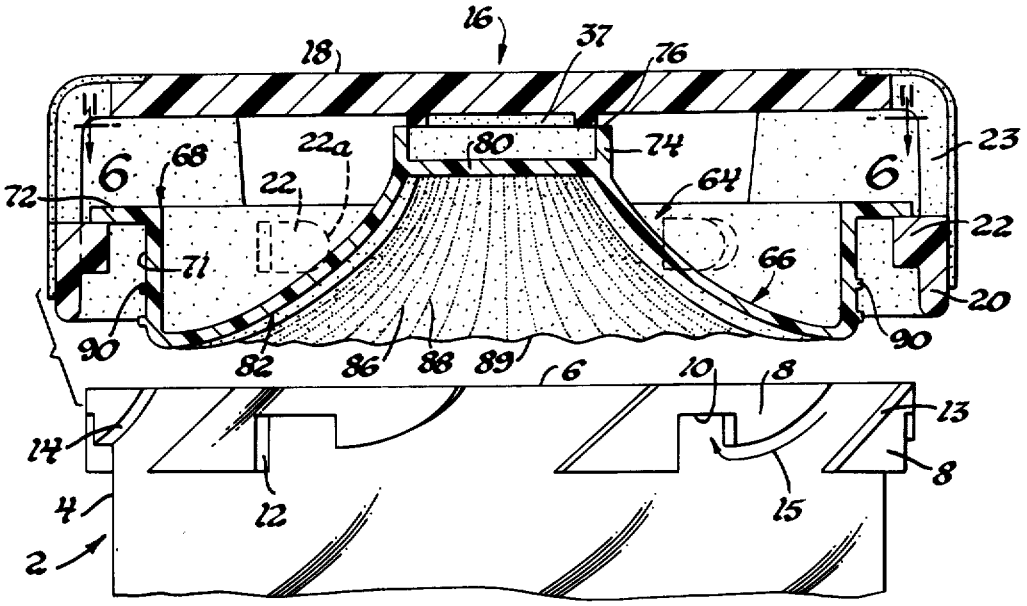
FIG. 4 is a sectional view of a second form of safety closure assembly embodying the invention, the closure assembly being removed from the container.
Figure 5:
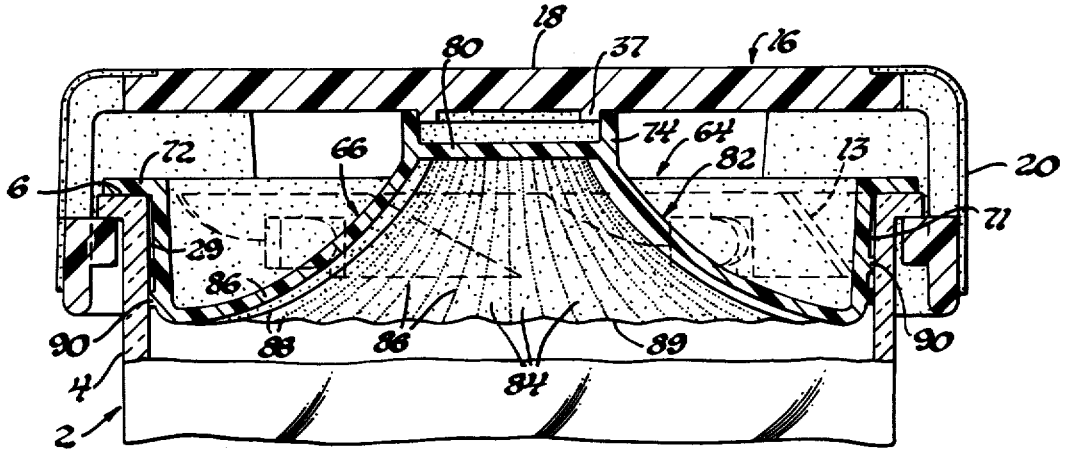
FIG. 5 is a sectional view of a safety closure and container assembly wherein the closure assembly of FIG. 4 is applied to a container.
Figure 6:
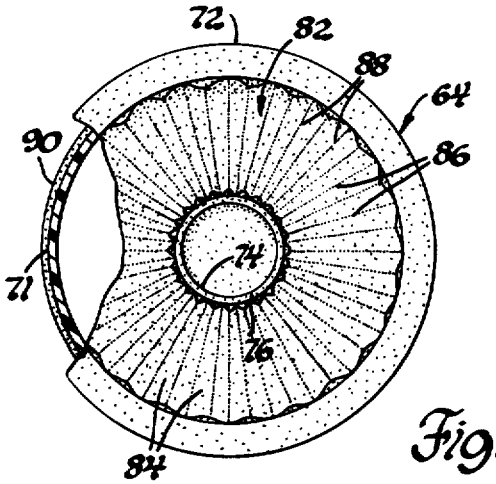
FIG. 6 is a plan view of the combined spring and sealing member of the closure assembly of FIGS. 4 and 5 as viewed along lines 6—6 of FIG. 4.

FIGS. 4 through 6 illustrate another embodiment of the invention. The cap and container illustrated in FIGS. 4 and 5 are identical to the cap and container of FIGS. 1 and 2. Received in the cap 16 of FIGS. 4 and 5 is a one-piece plastic spring and sealing member designated collectively by reference numeral 64.

The spring and sealing member 64 comprises a one-piece molded plastic body having an annular sealing portion designated generally by reference numeral 68 which, when the closure assembly is applied to the container as illustrated in FIG. 2, engages the rim 6 and the inner surface 29 of the mouth portion of the container. A bell shaped plunger 66 is formed integrally with the sealing portion 68.

The sealing portion 68 includes a cylindrical sealing wall 71 for engaging the inner surface of the mouth of the container, and a flange 72 projecting radially outwardly from the upper or outer end of the sealing wall 71 for overlying the container rim 6.

The bell shaped plunger portion 66 has a cylindrical base portion 74 which is concentric with the sealing wall 71. The base portion 74 has an outer cap engaging end 76 for engaging the inner surface of the end wall of the cap. The cylindrical projection 37 formed integrally on the inner surface of the end wall 18 of the cap cooperates with the base portion 74 to maintain the spring member 64 centered with respect to the cap. When the cap is in the locked position with respect to the container as illustrated in FIG. 2, the interengagement between the projection 37 and base portion 74 prevents transverse movement of the cap relative to the container so that the cap can only be disengaged from the container by movement in a substantially axial direction.

The base portion 74 is formed with a closure portion 80 at the inner end of the cylindrical wall of the base portion. Extending between the lower end of the base portion 74 and the inner end of the sealing wall 71 opposite flange 72 is a side wall 82. The side wall 82 is of fluted annular cross-section, as is described in detail below, and flares outwardly in bell shaped configuration from the periphery of the lower end of the base portion 74 to the periphery of the lower, inner end of the sealing wall 71.

Extending between the base portion 74 and the inner end of the cylindrical sealing wall is a plurality of radial stiffening members in the form of flutes 84. The flutes 84 are molded integrally into the side wall 82. The illustrated flutes 84 are of curved cross-section with alternating portions 86 and 88. Portions 86 project outwardly (or upwardly as viewed in FIGS. 4 and 5) from the side wall 82. Portions 88 project inwardly toward the container from the side wall 82 (or downwardly as viewed in FIGS. 4 and 5).

In the illustrated embodiment of FIGS. 4 through 6, the juncture of the lower periphery of the side wall with the lower, inner end of the cylindrical sealing wall 71 is of scalloped configuration as indicated by reference numeral 89.

In the illustrated embodiment of FIGS. 4 through 6, a pair of axially spaced sealing beads 90 project outwardly from the sealing wall 71. In the closed position of the cap as shown in FIG. 5, the beads 90 are pressed into tight, sealing engagement with the inner surface 29 of the mouth portion of the container.

When the cap is pressed axially toward the container, the base portion 74 of the spring and sealing member 64 is flexed toward the lower, inner end (at 89) of the sealing wall 71. The flutes 84 tend to flatten out and spread as a consequence of the resulting flexure of the side wall. The adjacent portions 86 tend to spread apart. The adjacent portions 88 tend to spread apart. The circumference at 89 tends to increase, which in turn increases the radial sealing pressure applied to the conainer wall 29. The flutes also act as stiffeners and apply downward and radially outward forces on the sealing wall 71 and flange 72 in the manner similar to that in which ribs 44 of the embodiment of FIGS. 1 through 3 apply downward and radially outward forces on the sealing wall 31 and flange 32 (as indicated by arrow 41 in FIG. 2).

The assembly of the cap 16 and sealing member 24 are shown disengaged from the container in FIG. 4. In the position of the member 64 as illustrated in FIG. 4, with the sealing flange 72 resting on the upper surfaces of the lugs 22, the base portion 74 only lightly engages or possibly may be spaced slightly from the end wall 18 of the cap 16. However, as illustrated in FIG. 5, when the cap locking elements 22 are engaged with the container locking elements 8, the cap engaging portion 76 engages the end wall 18 of the cap causing the flared or bell shaped side wall portion 82 to flex downwardly and outwardly to resiliently apply both an axial and radially outward component of force to press the sealing portion 68 into tight sealing engagement with the inner surface 29 of the container and against the rim 6.

Figure 7:
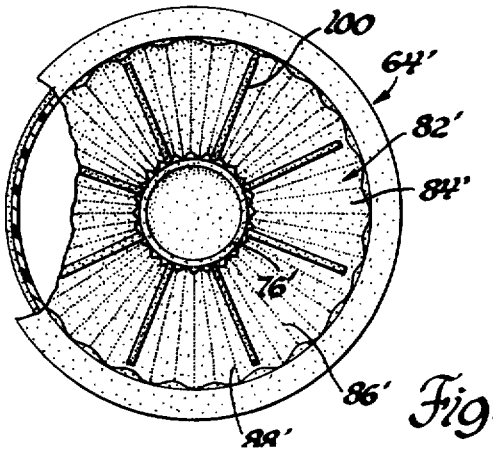
FIG. 7 is a view similar to FIG. 6 of another form of combined spring and sealing member embodying the invention.

FIG. 7 illustrates a modified form of the spring and sealing member 64 of FIGS. 4 through 6. The FIG. 7 embodiment is designated collectively by reference numeral 64', and in addition to flutes, is provided with a plurality of ribs 100. Except for the addition of ribs 100, member 64' of FIG. 7 is identical in construction to member 64 of FIG. 6. Portions of members 64' identical to member 64 are identified by primed reference numerals otherwise the same.

The ribs 100 may be of the same construction as ribs 44 of the embodiment of FIGS. 1 through 3. Each rib 100 has an inner edge molded integrally to the outer surface of the side wall 82' and the base portion 74', and projecting outwardly therefrom to a free edge 102. The free edge 102 corresponds to the free edge 46 of ribs 44. The inner edges of each of the ribs 100 of FIG. 7 are molded to the side surface 82' at one of the inwardly projecting portions 88' of the flutes 84'.

With each of the sealing members 24, 64 and 64', the respective base portions are compressed toward the inner or lower ends of the respective cylindrical sealing walls when the cap is applied to the container with elements 8 and 22 in locked engagement. This compression in turn tends to increase the circumference of the periphery of the lower end of the cylindrical sealing wall to apply sealing pressure on the container wall at 29.

While several specific forms of the invention have been illustrated in the accompanying drawings and described in the foregoing specification, it should be understood that the invention is not limited to the exact construction shown. To the contrary, alterations in the construction and arrangement of parts, all falling within the scope and spirit of the invention, will be apparent to those skilled in the art.

The embodiments of the present invention in which an exclusive property or privilege is claimed are defined as follows:

1. A safety closure assembly comprising: a cap having an end wall with a skirt projecting therefrom and a plurality of peripherally spaced bayonet locking elements formed on the inner surface of the skirt adapted to be engaged with and disengaged from complementary container bayonet locking elements on a container by combined axial and rotary motion of the cap relative to such container, and a combined spring and sealing member for sealingly engaging a container to which the cap is adapted to be applied and at the same time biasing the cap locking elements into locked engagement with the container locking elements, wherein the improvement comprises the spring and sealing member having a unitary plastic body with a cylindrical sealing wall having inner and outer ends for sealingly engaging the inner wall of the mouth of a container; a flange projecting radially outwardly from the outer end of said cylindrical sealing wall for overlying the container rim; a plunger having a base portion concentric with said cylindrical sealing wall and a side wall extending between said base portion and the inner end of said cylindrical sealing wall; and a plurality of radial stiffening members extending between said base portion and the inner end of said cylindrical sealing wall for applying radially outward sealing forces on said cylindrical sealing wall in response to flexure of the side wall of said plunger in response to movement of the base portion thereof toward the inner end of said cylindrical sealing wall.

2. An assembly as claimed in claim 1 wherein said plurality of radial stiffening members includes a plurality of ribs, said ribs each having an inner edge molded integrally to said side wall and projecting therefrom to a free edge.

3. An assembly as claimed in claim 2 wherein said plurality of radial stiffening members further includes a plurality of flutes molded into said side wall, said flutes tending to spread and increase the circumference of said inner end of said cylindrical sealing wall in response to said movement of the base portion toward the inner end of said cylindrical sealing wall.

4. An assembly as claimed in claim 1 wherein said plurality of radial stiffening members includes a plurality of flutes molded into said side wall, said flutes tending to spread and increase the circumference of said cylindrical sealing wall in response to said movement of the base portion toward the inner end of said cylindrical sealing wall.

5. A safety closure and container assembly comprising: a container having a mouth portion with an annular rim and a plurality of container locking elements spaced peripherally from each other on the outer surface of said mouth portion; a cap having an end wall with a skirt projecting therefrom for receiving said mouth portion, said cap having a plurality of cap locking elements formed integrally on the inner surface of said skirt; said cap locking elements being engageable with and disengageable from said container locking elements by an axial motion followed successively by a rotative motion of said cap relative to said container; a combined spring and sealing member carried by said cap, said combined spring and sealing member comprising a unitary plastic body with a cylindrical sealing wall projecting into the mouth of the container for sealing engagement with the inner surface of the mouth of the container, said cylindrical sealing wall having inner and outer ends; an annular sealing flange projecting radially outwardly from the outer end of said cylindrical sealing wall and overlying the rim of said container; a plunger having a base portion concentric with said cylindrical sealing wall and a side wall extending between said base portion and the inner end of said cylindrical sealing wall; and a plurality of radial stiffening members extending between said base portion and the inner end of said cylindrical sealing wall for applying radially outward sealing forces on said cylindrical sealing wall in response to flexure of the side wall of said plunger when said cap locking elements are engaged with said container locking elements.

6. An assembly as claimed in claim 5 further including a pair of axially spaced beads formed on the outer surface of said cylindrical sealing wall for sealing engagement with the inner surface of the mouth of the container.

7. An assembly as claimed in claim 6 wherein said annular sealing flange overlies said cap locking elements to prevent axial separation of said spring and sealing member from said cap, said spring and sealing member being otherwise unconnected with said cap.

8. An assembly as claimed in claim 7 wherein said container locking elements each project outwardly from the other surface of the container and are spaced peripherally from each other, and each includes a socket for receiving one of said cap locking elements with a cam surface extending from the top of the leading end of said container locking elements to said socket for guiding a cap locking element into said socket when the cap is rotated with respect to the container in a direction to lock the cap to the container, and a ramp surface extending from the top to a trailing end at the lower surface thereof for guiding a cap locking element from an adjacent container locking element upwardly into engagement with said radially projecting annular sealing flange when the cap is rotated with respect to said container in a direction to remove the cap from the container.

9. An assembly as claimed in claim 8 wherein said plurality of radial stiffening members includes a plurality of ribs, said ribs each having an inner edge molded integrally to said side wall and projecting therefrom to a free edge.

10. An assembly as claimed in claim 9 wherein said plurality of radial stiffening members further includes a plurality of flutes molded into said side wall, said flutes tending to spread and increase the circumference of said inner end of said cylindrical sealing wall in response to said movement of the base portion toward the inner end of said cylindrical sealing wall.

11. An assembly as claimed in claim 8 wherein said plurality of radial stiffening members includes a plurality of flutes molded into said side wall, said flutes tending to spread and increase the circumference of said cylindrical sealing wall in response to said movement of the base portion toward the inner end of said cylindrical sealing wall.

12. An assembly as claimed in claim 5 wherein said plurality of radial stiffening members includes a plurality of ribs, said ribs each having an inner edge molded integrally to said side wall and projecting therefrom to a free edge.

13. An assembly as claimed in claim 12 wherein said plurality of radial stiffening members further includes a plurality of flutes molded into said side wall, said flutes tending to spread and increase the circumference of said inner end of said cylindrical sealing wall in response to said movement of the base portion toward the inner end of said cylindrical sealing wall.

14. An assembly as claimed in claim 5 wherein said plurality of radial stiffening members includes a plurality of flutes molded into said side wall, said flutes tending to spread and increase the circumference of said cylindrical sealing wall in response to said movement of the base portion toward the inner end of said cylindrical sealing wall.

15. A safety closure assembly comprising: a cap having an end wall with a skirt projecting therefrom and a plurality of peripherally spaced bayonet locking elements formed on the inner surface of the skirt adapted to be engaged with and disengaged from complementary container bayonet locking elements on a container by combined axial and rotary motion of the cap relative to such container, and a combined spring and sealing member for sealingly engaging a container to which the cap is adapted to be applied and at the same time biasing the cap locking elements into locked engagement with the container locking elements, wherein the improvement comprises the spring and sealing member comprising a unitary plastic body having a cylindrical sealing wall for sealingly engaging the inner wall of the mouth of a container; a flange projecting radially outwardly from one end of said cylindrical sealing wall for overlying the container rim; a bell shaped plunger having a cylindrical base portion concentric with said cylindrical sealing wall; said base portion having an outer cap engaging end and an inner end, and a bell-shaped side wall of annular cross-section extending between said inner end of said base portion and the other end of said cylindrical sealing wall, said side wall flaring outwardly from said inner end of said base portion to said other end of said cylindrical sealing wall; and a plurality of ribs extending between said base portion and the inner end of said cylindrical sealing wall, said ribs each having an inner edge molded integrally to the outer surface of said side wall and said base portion and projecting outwardly therefrom to a free edge such that movement of said base portion towards said inner end of said cylindrical sealing wall causes said ribs and annular side wall to apply radially outward sealing forces on said cylindrical sealing wall, said radially outwardly projecting annular sealing flange overlying the cap locking elements to prevent axial separation of said spring and sealing member from said cap, said spring and sealing member being otherwise unconnected with said cap.

16. A safety closure and container assembly comprising: a container having a mouth portion with an annular rim and a plurality of container locking elements spaced peripherally from each other on the outer surface of said mouth portion; a cap having an end wall with a skirt projecting therefrom for receiving said mouth portion, said cap having a plurality of cap locking elements formed integrally on the inner surface of said skirt; said cap locking elements being engageable with and disengageable from said container locking elements by an axial motion followed successively by a rotative motion of said cap relative to said container; a combined spring and sealing member carried by said cap, said combined spring and sealing member comprising a unitary plastic body having a sealing portion and a biasing portion; said sealing portion including a radially projecting, annular sealing flange overlying the rim of said container; said sealing portion further including an axially extending cylindrical sealing wall projecting into the mouth of the container for sealing engagement with the inner surface of the mouth of the container; said biasing portion having a cylindrical base portion concentric with said sealing wall with a free end engageable with the end wall of the cap, said cap having a cylindrical flange depending from the end wall thereof for interengagement with the cylindrical base portion, limit transverse movement between said cap and plunger portion; a bell-shaped side wall of annular cross-section extending between said inner end of said base portion and the outer end of said cylindrical sealing wall, said side wall flaring outwardly from said inner end of said base portion to said other end of said cylindrical sealing wall; and a plurality of radial stiffening members extending between said base portion and the inner end of said cylindrical sealing wall, said radial stiffening members being molded integrally to said side wall such that movement of said cap toward said container causes said radial stiffening members and side wall to apply downwardly and radially outward sealing forces on said annular sealing flange and cylindrical sealing wall.

17. A safety closure assembly comprising: a cap having an end wall with a skirt projecting therefrom and a plurality of peripherally spaced bayonet locking elements formed on the inner surface of the skirt adapted to be engaged with and disengaged from complementary container bayonet locking elements on a container by combined axial and rotary motion of the cap relative to such container, and a combined spring and sealing member for sealingly engaging a container to which the cap is adapted to be applied and at the same time biasing the cap locking elements into locked engagement with the container locking elements, wherein the improvement comprises the spring and sealing member comprising a unitary plastic body having a cylindrical sealing wall for sealingly engaging the inner wall of the mouth of a container; a flange projecting radially outwardly from one end of said cylindrical sealing wall for overlying the container rim; a bell shaped plunger having a cylindrical base portion concentric with said cylindrical sealing wall; said base portion having an outer cap engaging end and an inner end, and a bell-shaped side wall of annular cross-section extending between said inner end of said base portion and the other end of said cylindrical sealing wall, said side wall flaring outwardly from said inner end of said base portion to said other end of said cylindrical sealing wall; and a plurality of flutes molded into said side wall and extending between said base portion and the inner end of said cylindrical sealing wall, said flutes comprising alternating inwardly and outwardly projecting portions of curved cross-section such that movement of said base portion towards said inner end of said cylindrical sealing wall causes said flutes and annular side wall to apply radially outward sealing forces on said cylindrical sealing wall, said radially outwardly projecting annular sealing flange overlying the cap locking elements to prevent axial separation of said spring and sealing member from said cap, said spring and sealing member being otherwise unconnected with said cap.

18. An assembly as claimed in claim 17 further including a plurality of ribs extending between said base portion and the inner end of said cylindrical sealing wall, said ribs each having an inner edge molded integrally to the outer surface of one of said flutes and said base portion and projecting outwardly therefrom to a free edge.

19. A combined spring and sealing member for a child proof safety package comprising: a one-piece molded plastic body having a cylindrical sealing wall for sealingly engaging the inner wall of the mouth of a container; an annular sealing flange projecting radially outwardly from one end of said cylindrical sealing wall for overlying a container rim; a plunger portion having a cap engaging base portion concentric with said cylindrical sealing wall; a side wall extending between said base portion and the other end of said cylindrical sealing wall, and a plurality of radial stiffening members extending between said base portion and said other end of said cylindrical sealing wall, said radial stiffening members being molded integrally to said side wall such that movement of said base portion towards said other end of said cylindrical sealing wall causes said side wall to apply downwardly and radially outward sealing forces on said sealing flange and cylindrical sealing wall.

20. A combined spring and sealing member for a child proof safety package comprising: a one-piece molded plastic body having a cylindrical sealing wall for sealingly engaging the inner wall of the mouth of a container; an annular sealing flange projecting radially outwardly from one end of said cylindrical sealing wall for overlying a container rim; a plunger portion having a cylindrical base portion concentric with said cylindrical sealing wall; said base portion having an outer cap engaging end and an inner end; a bell-shaped side wall of annular cross-section extending between said inner end of said base portion and the other end of said cylindrical sealing wall, said side wall flaring outwardly from said inner end of said base portion to said other end of said cylindrical sealing wall; and a plurality of ribs extending between said base portion and the inner end of said cylindrical sealing wall, said ribs each having an inner edge molded integrally to the outer surface of said side wall and said base portion and projecting outwardly therefrom to a free edge such that movement of said base portion towards said inner end of said cylindrical sealing wall causes said ribs and side wall to flex and apply downwardly and radially outward sealing forces on said sealing flange and cylindrical sealing wall.

21. A combined spring and sealing member for a child proof safety package comprising: a one-piece molded plastic body having a cylindrical sealing wall for sealingly engaging the inner wall of the mouth of a container; an annular sealing flange projecting radially outwardly from one end of said cylindrical sealing wall for overlying a container rim; a plunger portion having a cylindrical base portion concentric with said cylindrical sealing wall; said base portion having an outer cap engaging end and an inner end; a bell-shaped side wall of annular cross-section extending between said inner end of said base portion and the other end of said cylindrical sealing wall, said side wall flaring outwardly from said inner end of said base portion to said other end of said cylindrical sealing wall; and a plurality of flutes extending between said base portion and the inner end of said cylindrical sealing wall, said flutes being molded integrally to said side wall and having alternating inwardly and outwardly projecting portions of curved cross-section such that movement of said base portion towards said inner end of said cylindrical sealing wall causes said side wall to apply downwardly and radially outward sealing forces on said sealing flange and cylindrical sealing wall, and causes said flutes to spread and increase the circumference of said other end of said cylindrical sealing wall.

* * * * *